US006548456B1

(12) United States Patent
Mulder et al.

(10) Patent No.: US 6,548,456 B1
(45) Date of Patent: Apr. 15, 2003

(54) METAL WORKING FLUIDS

(75) Inventors: Hendrik Laurens Mulder, Mijdrecht (NL); Robertus Petrus Jozef Maria Smits, Uithoorn (NL); Nicolaas Leonardus Johanna Maria Broekhof, Hilversum (NL)

(73) Assignee: Quaker Chemical Corporation, Wilmington, DE (US)

( * ) Notice: Subject to any disclaimer, the term of this patent is extended or adjusted under 35 U.S.C. 154(b) by 0 days.

(21) Appl. No.: 10/018,798

(22) PCT Filed: Jun. 21, 2000

(86) PCT No.: PCT/NL00/00432

§ 371 (c)(1),
(2), (4) Date: Dec. 21, 2001

(87) PCT Pub. No.: WO00/78901

PCT Pub. Date: Dec. 28, 2000

(30) Foreign Application Priority Data

Jun. 21, 1999 (EP) ..... 99201983

(51) Int. Cl.[7] ..... C10M 133/44; C10M 149/10; C10M 173/00

(52) U.S. Cl. ..... 508/268; 508/469; 72/42

(58) Field of Search ..... 508/279, 268, 508/469; 72/42

(56) References Cited

U.S. PATENT DOCUMENTS

| | | | | | |
|---|---|---|---|---|---|
| 3,423,381 A | | 1/1969 | Merijan | | |
| 3,980,571 A | * | 9/1976 | Marx | ..... | 508/279 |
| 4,127,491 A | | 11/1978 | Reick | | |
| 4,349,444 A | | 9/1982 | Reick | | |
| 4,411,145 A | * | 10/1983 | Lewis et al. | ..... | 508/279 |
| 4,650,595 A | * | 3/1987 | Nagamori et al. | ..... | 508/279 |
| 4,810,489 A | | 3/1989 | Murray et al. | | |
| 5,021,526 A | | 6/1991 | Ball | | |
| 5,188,770 A | * | 2/1993 | Pennewiss | ..... | 44/395 |
| 5,431,756 A | | 7/1995 | Kosowski et al. | | |

FOREIGN PATENT DOCUMENTS

| | | | |
|---|---|---|---|
| CA | 2246680 | * | 3/2000 |
| GB | 1109330 | | 4/1968 |
| JP | 08 099832 | | 4/1996 |

* cited by examiner

*Primary Examiner*—Jacqueline V. Howard
(74) *Attorney, Agent, or Firm*—Young & Thompson

(57) ABSTRACT

Metal working fluids being oil-in-water emulsions comprising alkylated polyvinylpyrrolidones as surfactants for emulsifying the oil in water. The alkylated polyvinylpyrrolidones having a molecular weight of about 1,000 up to 50,000 provide emulsions showing a high emulsion stability under varying and severe processing conditions of metal working fluids. Further, advantages of the metal working fluids are the narrow distribution of the droplet size, the high stability against varying temperature, the high stability against varying quality/composition of the make-up water, a high capacity of dispersing metal fines in the metal working fluid as well as excellent film forming characteristics.

21 Claims, 9 Drawing Sheets

METAL WORKING FLUIDS

CROSS REFERENCE TO RELATED APPLICATION

Figure 1:
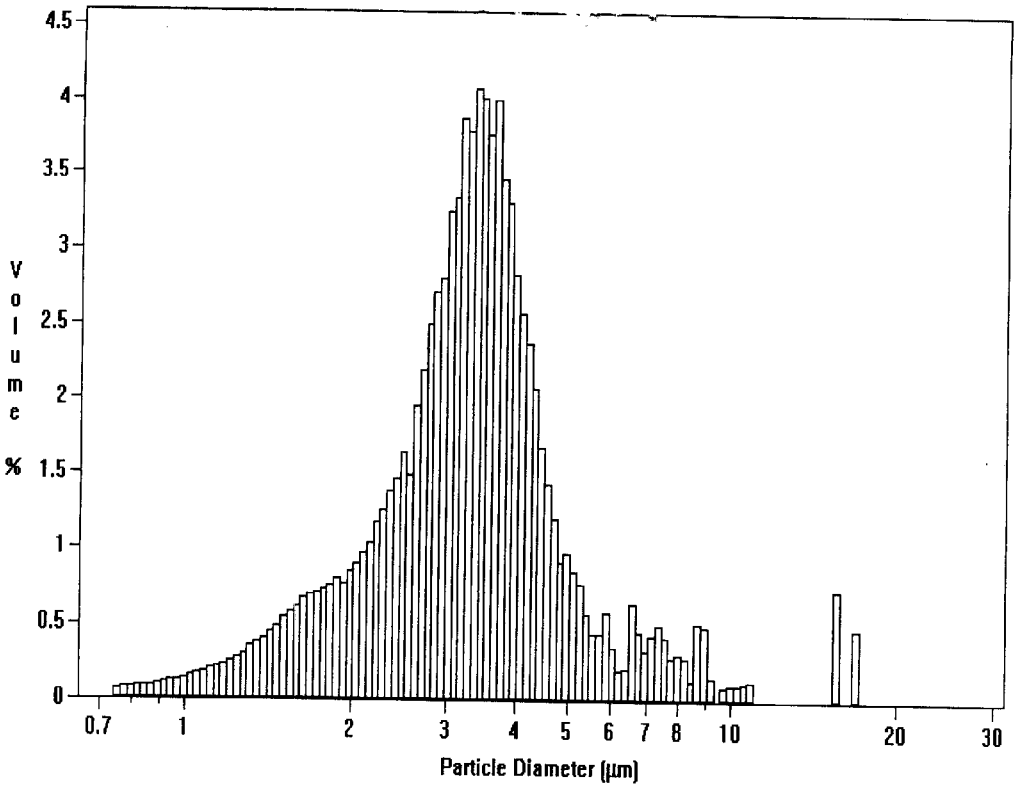

This is the 35 USC 371 national stage of international application PCT/NL00/00432 filed on Jun. 21, 2000, which designated the United States of America.

FIELD OF THE INVENTION

The invention relates to metal working fluid being oil-in-water emulsions and to the use of said metal working fluids in metal working processes like elastic deformation, plastic deformation and cold and hot working of metals.

BACKGROUND OF THE INVENTION

In Japanese patent application 54005847-A a metal working lubricant is disclosed which is based on 10–100 g/l of oxalic acid or oxalate, such as ferric oxalate, 5–80 g/l polyvinyl pyrrolidone having a mol.weight of 400–700,000 and/or a water soluble copolymer formed from vinyl pyrrolidone and other vinyl monomers such as vinyl acetate acrylic acid or like and 5–150 g/l of water soluble Ti organic compound. Such a lubricant can be applied to the metal surface to be worked by spraying, roll coating etc. Optionally, the coating is heated at 60–90° C. for increasing its adhesion and smoothness. However, such a metal working lubricant is not an oil-in-water (o/w) emulsion but an aqueous solution containing the above-mentioned water soluble ingredients.

The present invention relates to metal working fluids being oil-in-water emulsions comprising surfactants for emulsifying oil in water and to the preparation of stable emulsions having oil concentrations up to about 20 wt. % in their final use. Next to other relevant properties, the emulsions used as metal working fluids have to fulfil two performance properties of major importance: lubrication and cooling. Performance properties are very much related to the colloid-chemical properties of the emulsion. A stable performance requires a good control of these colloid-chemical properties of the emulsion.

Unfortunately, emulsions are quite unstable fluids. For example, they often show tendency to coalescence resulting in an increased mean particle size, changed particle size distribution and finally in oil and/or water separation.

This instability is even more pronounced when operating under varying and severe process conditions. In this respect variables like make-up water quality/composition, temperature, pH, tramp oil, shear and metal fines in the emulsion are considered important and crucial.

In view of the above it is brought forward that the values of these variables can vary over wide ranges, well-known to those skilled in the art. For example, water hardness values of between 0 dH (demineralised water) and 40 dH for make-up water are observed. Also known is that after preparation of the emulsion the ionic strength and/or water hardness may change/increase significantly during the operation due to evaporation of water or incoming metal fines and ions, resulting in a reduction or loss of relevant properties like emulsion stability, film forming properties and dispersing capacity.

Such instabilities of emulsions are highly unwanted. Users of metalworking emulsions strongly prefer stable emulsions having properties/performance not changing in time. Therefore, in the research and development area, producers of these emulsions will strive for maximisation of the emulsion stability, especially under practical, varying operating conditions.

For overcoming above stability problems it is proposed in the prior art to stabilise emulsions electrostatically and/or by steric hindrance. Steric hindrance is a very effective tool in stabilising emulsions against coalescence and is described in literature extensively. For obtaining this steric stabilisation of emulsions polymeric surfactants with hydrophilic and lipophilic moieties are successfully applied in different type of industries.

Surprisingly it has been found that the stability problems of metal working fluids being oil-in-water emulsions can be solved by using one or more alkylated polyvinylpyrrolidones as emulsifiers. Surprisingly, this type of emulsions does not only show a high emulsion stability against oil coalescence under varying and severe processing conditions but also show other advantages like

- narrow distribution of the droplet size of the metal working emulsions according to the invention;
- a high stability against varying quality/composition of the make-up water. Different from the alkylated polyvinyl pyrrolidones, other polymeric surfactants may contain polyoxyethylene groups as hydrophilic moiety. The water solubility of these groups is quite sensitive to the quality/composition of the make-up water (salts dissolved in the water phase). This varying water solubility does affect the HLB (hydrophile-lipophile-balance) of the surfactant and thus also emulsification and emulsion stability;
- a high capacity of dispersing metal fines in the metal working fluid; very good lubricant film forming characteristics, even under low speed conditions (plate-out on steel; $\geqq 200$ mg/m$^2$ per % wt. oil);

More in particular the alkylated polyvinylpyrrolidones are based on vinylpyrrolidone and one or more compounds selected from the group consisting of olefins and alkyl (meth)acrylates. In this respect the olefins are $C_4$–$C_{30}$ $\alpha$-olefins, preferably $C_{10}$–$C_{22}$ $\alpha$-olefins, whereas the alkyl (meth)acrylates are $C_4$–$C_{30}$ alkyl (meth)acrylates, preferably $C_{10}$–$C_{22}$ alkyl (meth)acrylates.

The alkylated polypyrrolidones may be illustrated by the formula

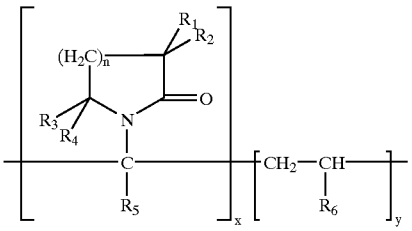

wherein $R_1$–$R_5$=H, $C_{1\text{-}30}$ alkyl and $R_6$=$C_2$–$C_{30}$ alkyl, and x and y have such values that the alkylated polyvinylpyrrolidones have a Mw (weight average) of 1,000 up to 5,000, preferably 2,000 up to 25,000. The molecular weight of a polymeric compound cannot be measured accurately. The results are very depending on the applied method and even the selected reference compound. The molecular weights (weight averaged) mentioned were measured by Gel Permeation Chromatography, unless otherwise stated. The average MW's must be considered as indications, rather than absolute values.

The alkylated polyvinylpyrrolidones (APVP's) can easily be prepared by copolymerisation of vinylpyrrolidone and an α-olefin or alkyl(meth)acrylate, well-known to those skilled in the art and also described in U.S. Pat. Nos. 3,423,381 and 3,417,054.

The metal working fluids according to the invention comprise alkylated polyvinylpyrrolidones wherein the vinylpyrrolidone content in the alkylated polyvinylpyrrolidone is from 5 to 80 mol. %. preferably from 10 to 60 mol. %, According to their composition the alkylated polyvinylpyrrolidones are soluble in lubricant base oils and have a limited water solubility, a water solubility strongly reduced if compared with that of the (unalkylated) polyvinylpyrrolidones. The water solubility of polyvinylpyrrolidones is too high for making these compounds surfactants with sufficient emulsion stabilising capacity. By alkylation of polyvinylpyrrolidones the water solubility is reduced and APVP's are obtained with HLB-values in the more appropriate range. In this respect it is pointed at the Handbook Kirk Othmer, fourth ed., vol. 7, page 881, indicating that oil-in-water (o/w) emulsions (i.e. the type of emulsions according to the invention) are best stabilized by water-soluble emulsifiers and water-in-oil (w/o) emulsions are best stabilized by oil-soluble ones. In the table on page 881 of the Kirk Othmer reference the o/w emulsifiers do have a HLB-value in the range of 8 to 18, i.e. a high hydrophilic moiety content (which is contrary to the alkylated polypyrrolidones applied according to the present invention).

In view of the above it is brought forward that alkylated polyvinylpyrrolidone copolymers are marketed by GAF/ISP under the trade name AGRIMER AL series, being dispersing agents for improved film formation of micro-emulsions for plant and crop protection, veterinary dips, knapsack sprayers and wood treatment, and under the trade name ANTARON V series:

as mineral oil soluble dispersant used as viscosity-index improver, pour-point depressant, and sludge and detergent dispersant. Dispersant for graphite and molybdenum disulphide based lubricants;

protective colloid in bulk high solid dispersions; applied in paints, inks and coatings, and as temporary coatings; oil soluble, water resistant coatings, e.g. replacement for lanolin as anti-corrosive coating.

As specific compounds can be listed:

a) ANTARON WP-660 (CAS-Nr. 26160-96-3) is derived from a $C_{30}$ α-olefin (=1-triacontene) and vinvlpyrrolidone and is applied as an oil soluble, water proofing agent in skin care/cosmetic products (sun protection). The HLB was given as 4 (calculated) HLB=20(H/H+L); H=hydrophilic portion; L=lipophilic portion)

b) ANTARON V-216 (CAS-Nr. 00063231-81-2) is derived from a $C_{16}$ α-olefin (=1-hexadecene) and vinylpyrrolidone. The polymer contains 20% vinylpyrrolidone. The MW (membrane osmometer with toluene as solvent) is 7300. The HLB was given as 4 (calculated). HLB=20(H/H+L); H=hydrophilic portion; L=lipophilic portion)

c) ANTARON V-220 (CAS-Nr. 28211-18-9) is derived from a $C_{20}$ α-olefin (=1-eicosene) and vinylpyrrolidone. The polymer contains 20% vinylpyrrolidone. The MW (membrane osmometer with toluene as solvent) is 8600 The HLB was given as 5 (calculated). HLB=20 (H/H+L); H=hydrophilic portion; L=lipophilic portion)

d) ANTARON V-516 (CAS-Nr. 00063231-81-2) is derived from a $C_{16}$ α-olefin (=1-hexadecene) and vinylpyrrolidone. The polymer contains 50% vinylpyrrolidone. The MW (membrane osmometer with toluene as solvent) is 9500. The product contains 55% active ingredient and 45% isopropyl alcohol. The HLB was given as 10 (calculated). HLB=20(H/H+L); H=hydrophilic portion; L=lipophilic portion); and e) ANTARON P-904 (CAS-Nr. 26160-96-3); polymer from 1-ethenyl-2-pyrrolidone and 1-butene ($C_4$).

With respect to the solubility of the alkylated polyvinylpyrrolidones in lubricant base oils it is stated that said solubility should range from at least 0.1 wt. % up to 50 wt. %, preferably from 0.5 wt % up to 5 wt %. High solubility up to about 50 wt % is desired for solubilising the APVP in a suitable carrier, preferably a base lubricant to avoid any compatibility problems. Suitable carriers are low viscous lubricant base oils, like mineral oils, (synthetic) esters, etc. Contrary thereto the solubility of the "water-insoluble" alkylated polyvinylpyrrolidones in water is less than 15 wt. %, preferably less than 5 wt. %. more preferably 1 wt. % or even 0.1 wt. %. It is known that the HLB of the surfactant selected for emulsification and stabilising the emulsion should match with the polarity of the lubricant base oil to be emulsified. The same holds for APVP's and therefore the water-and-oil solubility of APVP's according to the invention varies with their HLB-values. Methods for synthesis of the APVP according to the invention are extensively described in U.S. Pat. No. 3,423,381 and U.S. Pat. No. 3,417,054. Other methods for making APVP's of this invention are known to those skilled in the art. Instead of isopropyl alcohol other solvents might be used for the preparation of APVP's. It is possible to replace the solvent after the synthesis by another solvent or carrier (hydrocarbon solvent, mineral oil, synthetic lubricant base oil, etc.) to facilitate transport and blending operations later when making the complete metal working formulation.

Concerning the oil component or lubricant component of the o/w emulsions according to the invention it is stated that such a base lubricant component can be selected from the group consisting of mineral oils, synthetic lubricants and blends of both.

Mineral oils are obtained by oil drilling and then fractionated and purified. Generally, the viscosity of such oils fall in the range of from 10 cS to 1000 cS at 40° C., preferably from 20 cS to 150 cS at 40° C.

Synthetic lubricants are generally known in the art. Examples of such lubricants are esters, poly-α-olefins, polyglycols etc., all having a hydrophobic character and for that reason suitable for the preparation of the metal working as fluids according to the invention. More in particular esters may be selected from the group consisting of (a) natural esters like vegetable and animal fats and oils being triglycerides of glycerol and fatty acids, and (b) synthetic esters of polyalcohols (polyols) and fatty acids of natural and synthetic origin having a chain length in the range of $C_8$–$C_{30}$. Examples of synthetic esters are esters of fatty acids and polyols like pentaerythritol, trimethylolpropane, neopentylglycol etc.

As the metal working fluids according to the invention are oil-in-water emulsions, in their final use the oil content is generally at most 35 wt. %, preferably less than 15 wt. % and most preferably less than 10 wt. %. However, for concentrated emulsions the oil content may even be 60 wt. %, for instance 50 wt. %.

The emulsions according to the invention can be obtained in two different ways:

Directly. The emulsions (in their final use) are prepared by emulsification of an emulsifiable oil containing the alkylated pole vinylpyrrolidones according to the invention in water.

Indirectly. The emulsions are prepared in 2 steps by firstly making a concentrated emulsion and secondly by diluting simply this concentrated emulsion with water. The concentrated emulsion is an oil-in-water emulsion of about 60 wt. % oil in water stabilized with alkylated polyvinylpyrrolidones surfactants.

This last approach has some interesting advantages. The final emulsion can be prepared by simply diluting the concentrated emulsion with water. Neither special equipment, nor co-surfactants are needed to prepare the emulsion.

The metal working fluids according to the invention are o/w emulsions and more particularly o/w macro-emulsions having a mean particle size above 0.1 $\mu$m.

Further the metal working fluids may optionally comprise all kinds of additives like sulfur additives, for instance sulfurised oils or fats, phosphorous containing anti-wear agents, extreme pressure additives, corrosion inhibitors, anti-oxidants, etc. well known to those skilled in the art.

A typical corrosion inhibitor can be selected from the families of the azoles. Illustrative azole-type corrosion inhibitors are benzotriazole, tolutriazole, the sodium salt of mercapto-benzotriazole, naphthotriazole, methylene bis-benzo-triazole, dodecyltriazole and butylbenzotriazole, preferably tolutriazole. A suitable, commercially available form of benzotriazole which may be used in the invention is CORBRATEC®, marketed by PMC Specialties Group, Inc. (Rocky River. Ohio, U.S.A.). Also alkyl succinic anhydrides, alkenyl succinic anhydrides, fatty acids with a chain length in the range of $C_{12}$–$C_{30}$, from natural original as well as from synthetic origin, including the so-called technical fatty acids, are used as corrosion inhibitors, as such or as soaps made thereof. Soaps of (alkyl)amines, alkanol amines, lithium, potassium or sodium are well-known and often used. A typical sulphur additive may be selected from the group consisting of:

sulphurised esters of natural oils, like sulphurised lard oil, sulphurised sperm oil, or sulphurised rape seed oil, sulphurised castor oil, sulphurised soybean oil, and sulphurised race bran oil, sulphurised esters of synthetic original, like sulphurised fatty acid esters, sulphurised oleic acid; methyl ester of sulphurised oleic acid; octyl ester of sulphurised rice bran fatty acid, etc.;

sulphurised olefins;

polysulphides, like dialkyl polysulphides, dihydrocarbyl polysulphides; and further: thiocarbamaters, thioterpenes, and dialkyl thiodipropionates. A typical anti-wear and extreme pressure additive may be selected from the group consisting of: zinc dialkyl or diaryl dithiophosphates; triaryl phosphates; trialkyl phosphates; polymeric nitrogen/phosphorous compounds made, for example, by reacting a dialkoxy amine with a substituted organic phosphate; amine phosphates; triphenyl phosphorothionate and dihydrocarbyl dithiophosphate metals salts. A typical antioxidant may be selected from the group consisting of: Hindered phenols, such as 6(t-butyl)phenol, 2,6-di(t-butyl)phenol, 4methyl-2,6-di-(t-butyl)phenyl, 4,4'-methylenebis(-2,6-di-{t-butyl}phenol), and the like. Alkaline earth metal salts of alkylphenolthioesters, calciumnonylphenol sulfide, ashless oil soluble phenates and sulfurized phenates, phosphosulfuirized or sulfurized hydrocarbons, phosphorous esters, metal thiocarbamates, oil soluble copper compounds. Molybdenum containing compounds, like molybdenum octoate (2-ethyl hexanoate), naphthenate or stearate; overbased molybdenum-containing complexes; molybdenum dithiocarbamates and molybdenum dithiophosphates; oil-soluble molybdenum xanthates and thioxanthates; oil-soluble molybdenum- and sulfur-containing complexes. Aromatic amines, like diphenyl-, dinaphthyl-, and phenylnaphthyl amines, in which the phenyl and naphthyl groups can be substituted, e.g. N,N'-diphenyl phenylenediamine, p-octyldiphenylamine, p,p-dioctyldiphenylamine, N-phenyl-1-naphthyl amine, N-phenyl-2-naphthyl amine, N-(p-dodecyl)phenyl-2-naphthylaamine, di-1-naphthylamine, and di-2-naphthylamine; pehnothazines such as N-alkylphenothiazines: imino(bisbenzyl).

A final, optional component which may be added is a cosurfactant, preferably a non-ionic surfactant, like alkyl-, arylethoxylates, polyethyleneglycol esters, ethoxylated sorbitan esters, or sulfonic acid derivatives and salts thereof, etc. with such a component emulsification can be achieved at lower energy levels (low energy emulsification).

The addition of the mentioned optical components is common practice in formulating metal working fluids and well-known to those skilled in the art.

A further aspect of the invention is directed to the use of the metal working fluids in metal working processes. Typical metal working processes involve elastic deformation, plastic deformation or cold working of metals, with or without metal removal. In some of these operations the metal piece is deformed only, like in rolling and drawing of steel and aluminium, while in others metal is rather removed than deformed, like in cutting, grinding, broaching, machining and drilling of metals. The metallic materials from which the metal working apparatus and articles to be fabricated are made, include cast iron, steels (carbon steels, alloyed steels) as well as aluminium, aluminium alloys, other non-ferrous metals and their alloys, including components such as titanium, magnesium, copper, tin and brass.

The invention is elucidated by means of the following examples wherein the following test methods are applied:

SHEAR STABILITY TEST

Emulsification and emulsion stability are tested in a long-term Emulsion Recirculation Test (uptil 2 weeks). The emulsion is pumped around throught a 10 litre system under practical conditions of temperature, shear levels, tramp oil level, etc., all depending on the system in focus. The emulsion stability is assessed by measuring with time relevant emulsion properties, like droplet size distribution, the volume of oil separated from the emulsion, oil concentration, metal fines dispersing capability, etc.

PLATE-OUT

The plate-out is the amount of oil in mg/m$^2$ left on a steel panel after spraying this panel with the emulsion under practical conditions (spray nozzle type, pressure, temperature). After spraying the excess of emulsion is removed from the panel with an air-knife. The plate-out is measured by weighing the dried panel before and after spraying. Plate-out tests were conducted during Shear Stability Tests.

IRON FINES DISPERSION TEST

Iron fines with diameters in the micrometer range are mixed with the emulsion. The mixture is vigorously shaken. Depending on how well the fines are dispersed 5 ratings were defined for classification: "excellent", "finely dispersed", "borderline performance", "badly dispersed", "very bad". Iron Fines Dispersion Tests were conducted during Shear Stability Tests.

DROPLET SIZE DISTRIBUTION

A wide range of equipment is commercially available for measuring accurately droplet size distributions of emulsions. Suitable and used apparatus is the Coulter Counters apparatus marketed by Beckman Coulter. Inc.

EXAMPLES

Example 1

With this example is not only shown that emulsions for metal working operations, based on APVP, are very stable with a well defined, narrow particle size distribution, but also that the ratings concerning emulsion properties like plate-out, oil loss due to emulsion instability and iron fines dispersing capability are very high.

A 3 wt % oil-in-water emulsion was prepared from an oil consisting of 99 wt % of a trimethylol propanetriester and 1 wt % $C_{16}$-alkylated polyvinylpyrrolidone ($C_{16}$-APVP) and recirculated in the Shear Stability Test. The $C_{16}$-APVP was Antaron V516 of which the carrier (isopropanol) was removed. After 72 hrs at 45° C., the following emulsion characteristics were measured:

| Characteristic | unit | Demi-based | 10°dH-based |
|---|---|---|---|
| emulsion particle size (geometric mean) | μm | 3.1 | 3.5 |
| pH | — | 5.5 | 5.5 |
| plate-out | mg/m$^2$ | 750 | 700 |
| remaining oil concentration | wt % | 2.7 | 2.8 |
| iron fines dispersing test | appearance | finely dispersed | finely dispersed |

Figure 2:
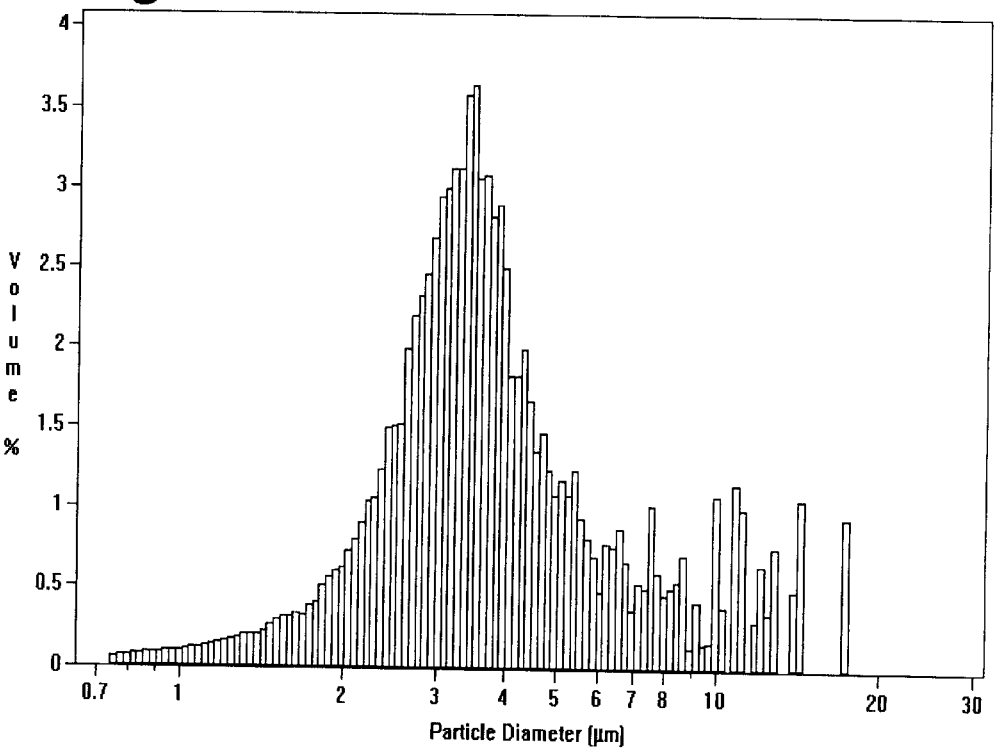

We measured the following particle size distributions, i.e. see:

FIG. 1 for the particle size distribution for an emulsion with demi water as make-up water (example 1), and FIG. 2 for the particle size distribution for a 10° dH water-based emulsion of example 1.

Figure 3:
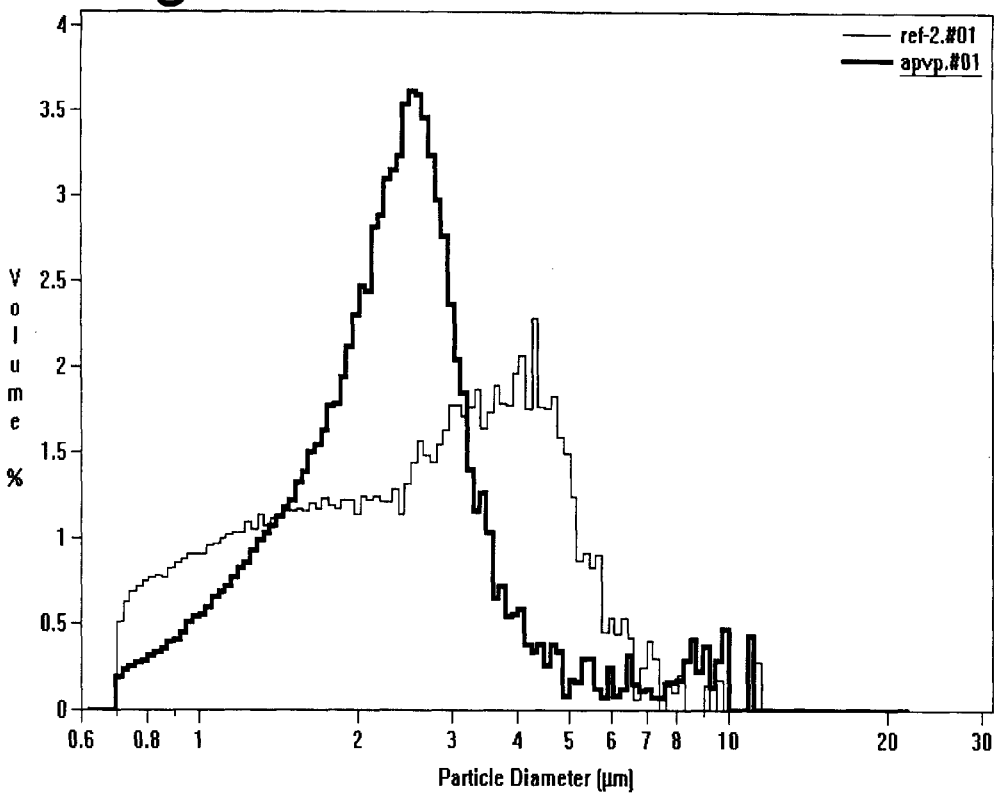

A 2.5 wt % (initial oil concentration) oil-in-water emulsion based on conventional surfactants and currently applied as low performing metal working fluid showed under the same conditions a low plate-out of 244 mg/m$^2$, oil concentration of 2.0 wt % (20% oil loss due to coalescence) and the poorly defined particle size distribution as indicated in FIG. 3. More in particular FIG. 3 shows the particle size distribution based on conventional surfactants (ref. 2) in comparison with an APVP-based emulsion.

Ref. 2 is the emulsion with demineralised water as make-up water and based on conventional surfactants. The graph indicated with "apvp" is an emulsion based on alkylated polyvinylpyrrolidones. Particle size distributions of APVP-based emulsions can also be found in the other examples.

Example 2

A product was prepared, consisting of 80.5 wt % trimethylol tropanetriester, 10 wt % of a 100 cS (40° C.) paraffinic, mineral oil, 8 wt % sulphurised lard oil, 0.25 wt % tetrabutyl methylenediphenol, 0.25 wt % tolutriazole and 1 wt % $C_{16}$-alkylated PVP (from example 1).

Compared with example 1, no important interactions due to the addition of additives were observed. Again we observed a stable emulsion (particle size distribution; oil concentration), high plate-out values and good dispersion of iron fines in the emulsion. After 72 hrs circulation at 45° C. the following emulsion characteristics were measured:

| Characteristic | Unit | Demi-based | 10°dH-based |
|---|---|---|---|
| emulsion particle size (geometric mean) | μm | 3.5 | 3.5 |
| pH | — | 4.8 | 5.5 |
| plate-out | mg/m$^2$ | 580 | 610 |
| remaining oil concentration | wt % | 2.9 | 2.9 |
| iron fines dispersing test | appearance | excellent | excellent |

Figure 4:
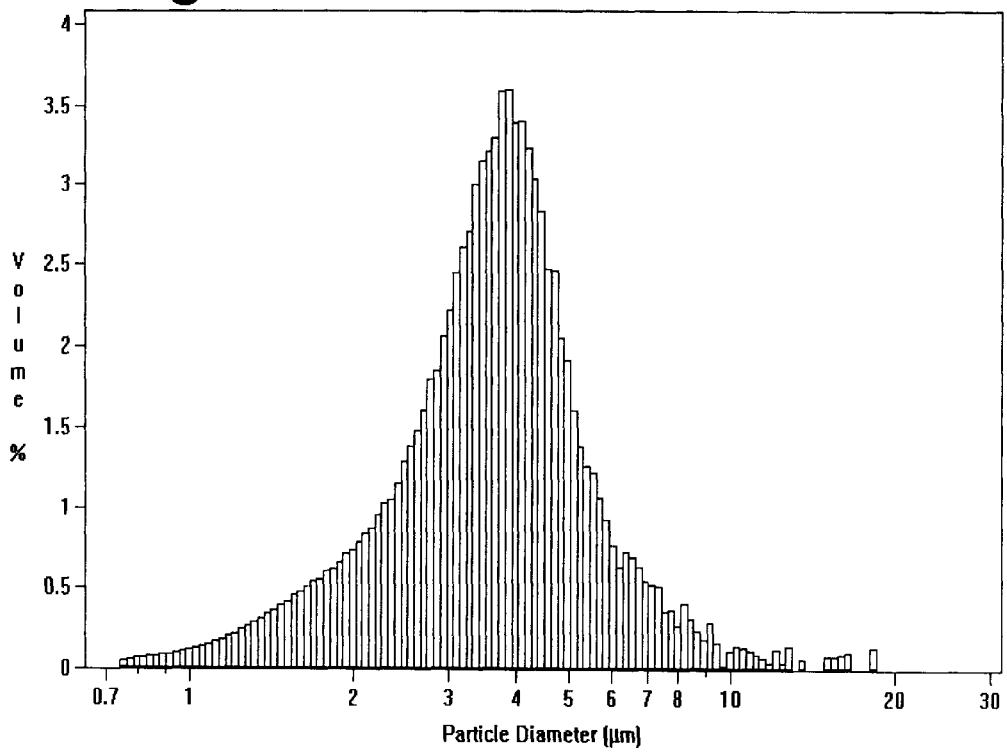

The particle size distributions are illustrated in:

FIG. 4 for a demi water-based emulsion (example 2), and in

Figure 5:
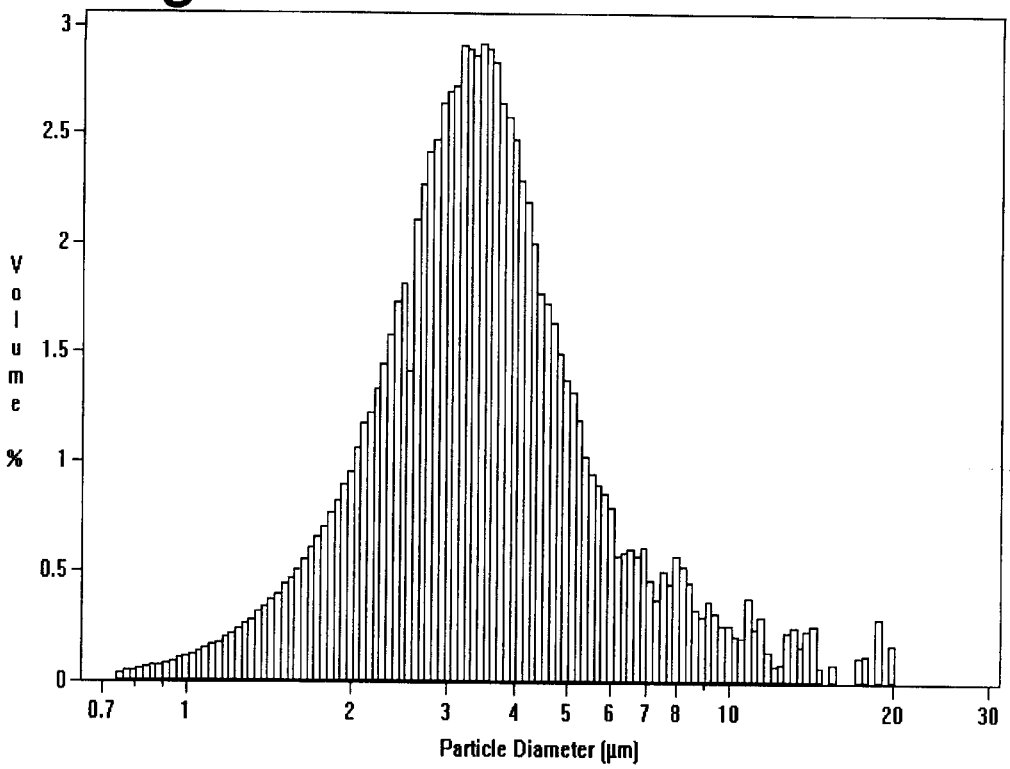

FIG. 5 for a 10° dH water-based emulsion (example 2).

Example 3

With this example it is shown that the emulsion properties are not affected by a temperature increase from 45° C. to 60° C.

A product was made, consisting of 79.5 wt % trimethylol propanetriester, 10 wt % of a ca 100 cS (40° C.) paraffinic, mineral oil, 8 wt % sulphurised lard oil (10 wt % S), 0.25 wt % tetrabutyl methylenediphenol, 0.25 wt % tolutriazole, 1 wt % tricresyl phosphate and 1 wt % $C_{16}$-alkylated PVP (from example 1).

A 3 wt % oil-in-water emulsion was prepared thereof. After 72 hrs circulation of this emulsion at 60° C., the following emulsion characteristics were measured:

| Characteristic | Unit | Demi-based | 10°dH-based |
|---|---|---|---|
| emulsion particle size (geometric mean) | μm | 3.1 | 3.5 |
| pH | — | 6.0 | 5.2 |
| plate-out | mg/m$^2$ | 670 | 620 |
| remaining oil concentration | wt % | 2.7 | 2.7 |

Figure 6:
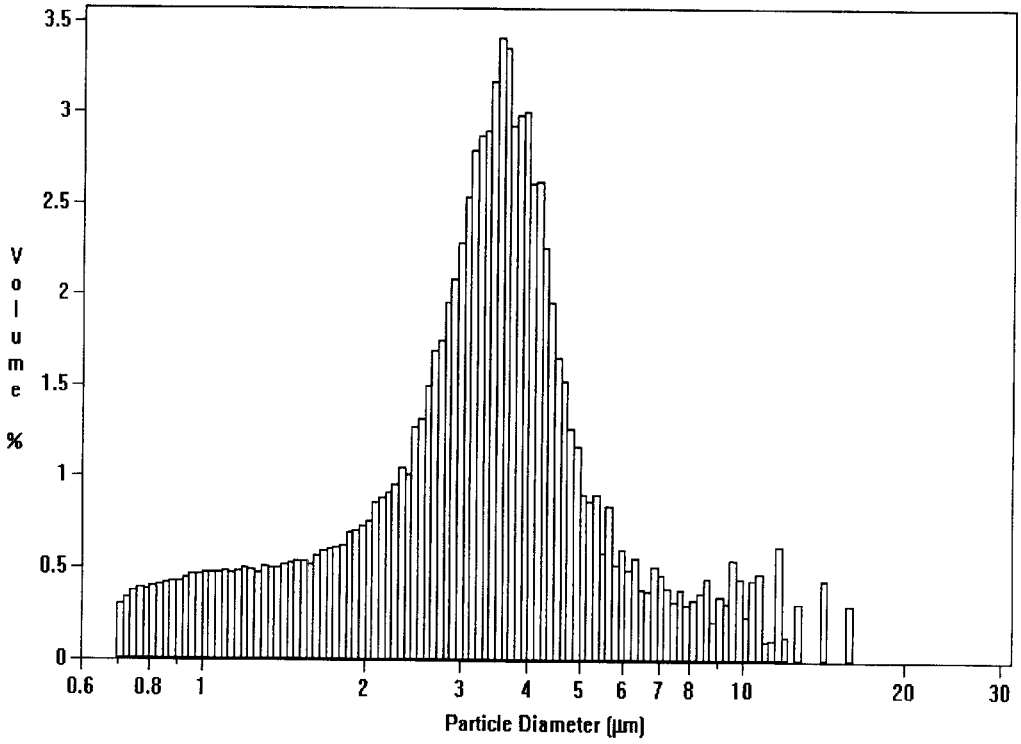

We measured the following particle size distributions as illustrated in:

FIG. 6 for a demi-based emulsion (example 3), and in

Figure 7:
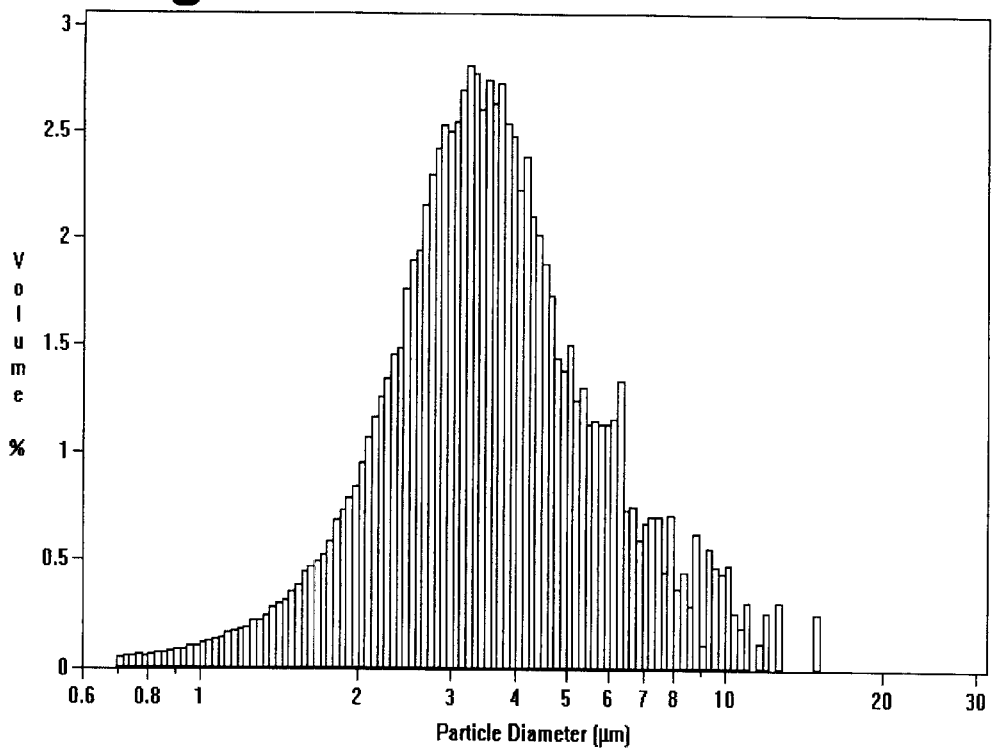

FIG. 7 for a 10° dH-based emulsion (example 3).

Example 4

With this example is shown that by increasing the initial pH of the emulsion from 5.6 to a pH of about 8.0 again stable emulsions are obtained. However the mean particle size decreases, even to below 1.0 micrometer.

A product was prepared, consisting of 99 wt % trimethylol propanetriester and 1 wt % $C_{16}$-alkylated PVP (from example 1). At the start of the test, the pH of the emulsion (3 wt % of the oil in water) was set to 8.0 using 0.1M KOH solution. After 48 hrs circulation at 45° C., the following emulsion characteristics were measured:

| Characteristic | Unit | Demi-based |
|---|---|---|
| emulsion particle size (geometric mean) | μm | <1.0 |
| pH | — | 7.4 |
| remaining oil concentration | wt % | 2.6 |

Figure 8:
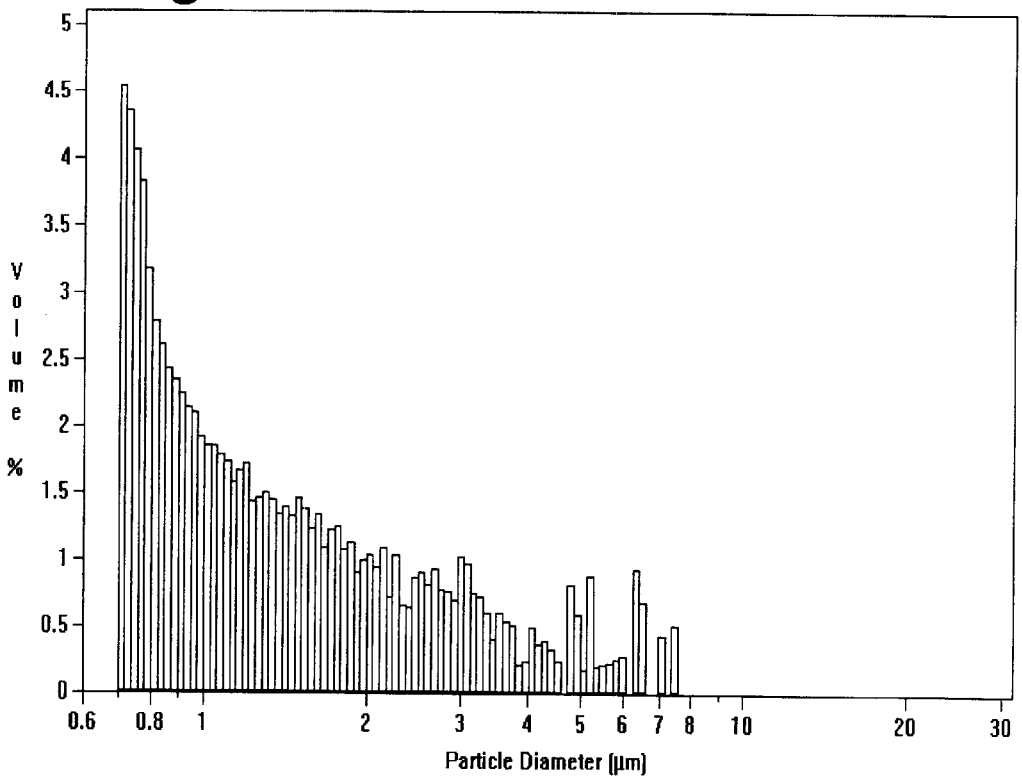

FIG. 8 shows the particle size distribution for a demi water-based emulsion of product example 4.

Example 5

With this example is shown that conventional type, monomeric surfactants can be used as co-surfactants to adjust certain emulsion properties. It may be desirable to adjust properties, such as emulsification, plate-out, depending on what is required to run the process of a particular metal working operation. For instance such surfactants may be non-ionic, alkyl ethoxylates, aryl ethoxylated, alkyl/aryl ethoxylates, polyglycol esters, and ethoxylated sorbitan esters.

A product was prepared, consisting of 78.9 wt % trimethylol propanetriester, 10 wt % paraffinic mineral oil, 7 wt % sulphurised lard oil, 0.25 wt % tetrabutyl methylenediphenol, 0.25 wt % tolutriazole), 0.6 wt % tricresyl phosphate, 2 wt % PEG (20) sorbitan mono-oleate and 1 wt % $C_{16}$-APVP (from example 1).

The 3 wt % oil-in-water emulsion prepared of this oil was stable again, however it can be seen from the table below that the values of certain emulsion properties, like plate-out, particle size, may shift in a minor way. After 114 hrs circulation at 45° C. the following emulsion characteristics were measured:

| Characteristic | Unit | Demi-based | 10°dH-based |
|---|---|---|---|
| emulsion particle size (geometric mean) | μm | 2.2 | 2.1 |
| pH | — | 4.8 | 4.7 |
| plate-out | mg/m² | 390 | 300 |
| remaining oil concentration | wt % | 2.8 | 2.9 |
| iron fines dispersion test | appearance | finely dispersed | Finely dispersed |

Figure 9A:
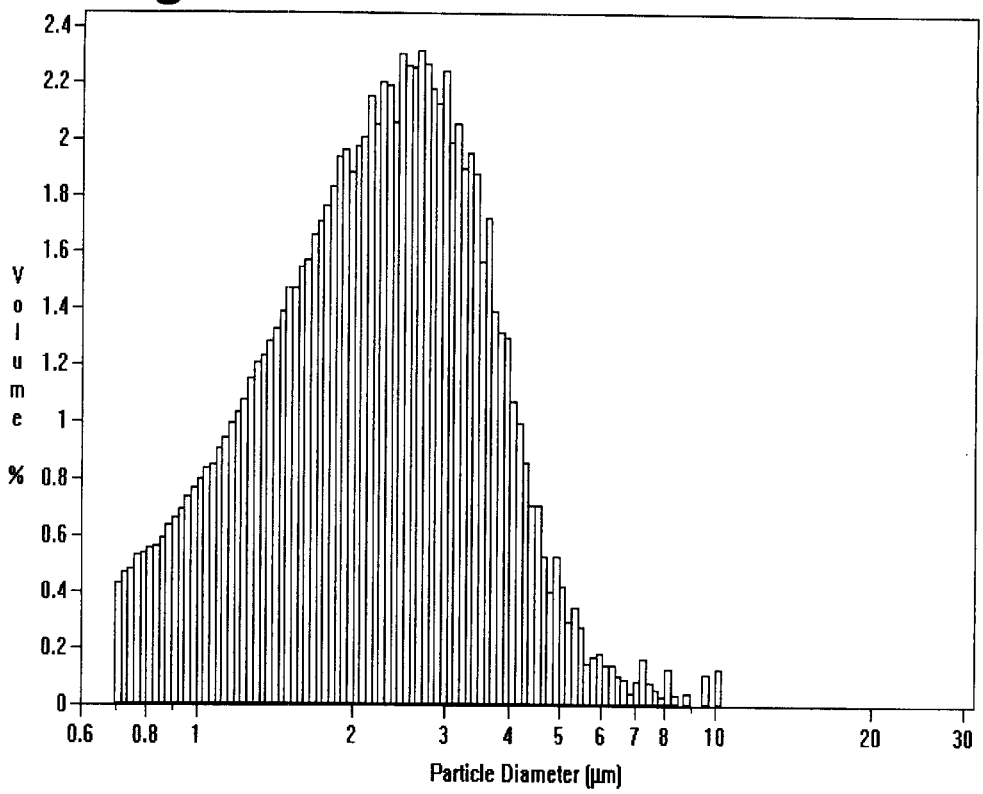
Figure 9B:
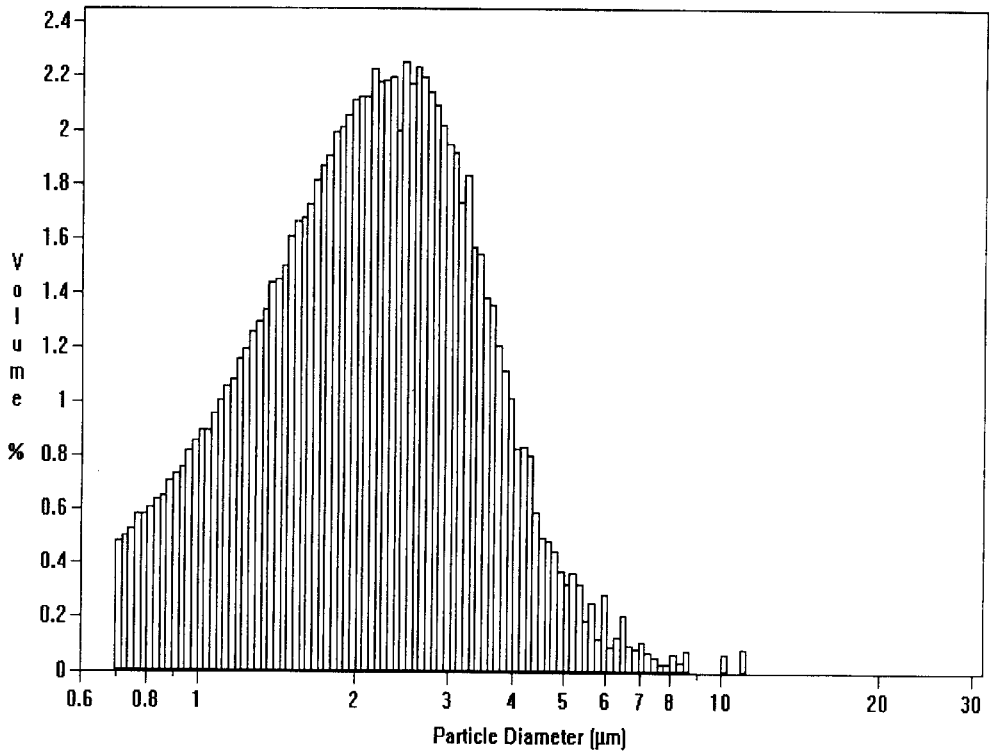

In FIG. 9*a* and FIG. 9*b* the particle size distribution for a demi-water emulsion (top) and for a 10° dH water-based emulsion (down) of product example 5 are illustrated.

Example 6

With this example is shown that lowering the oil concentration of the emulsion (from 3 to 2 wt %) does not affect the particle size distribution. Plate-out and oil concentration at the end of the test goes down proportionally with the initial oil concentration.

A product was prepared, consisting of 70.7 wt % trimethylol propanetriester, 22.3 wt % mineral oil, 5 wt % sulphurised lard oil, 0.25 wt % tetrabutyl methvlenediphenol, 0.25 wt % tolutriazole, 0.5 wt % tricresyl phosphate and 1 wt % $C_{16}$-alkylated PVP (from example 1).

A 2.0 wt % emulsion was prepared using demi water. After 96 hrs circulation at 45° C., the following emulsion characteristics were measured:

| Characteristic | Unit | Demi-based |
|---|---|---|
| emulsion particle size (geometric mean) | μm | 3.0 |
| pH | — | 4.2 |
| plate-out | mg/m² | 400 |
| remaining oil concentration | wt % | 1.6 |
| iron fines dispersion test | Appearance | excellent |

Figure 10:
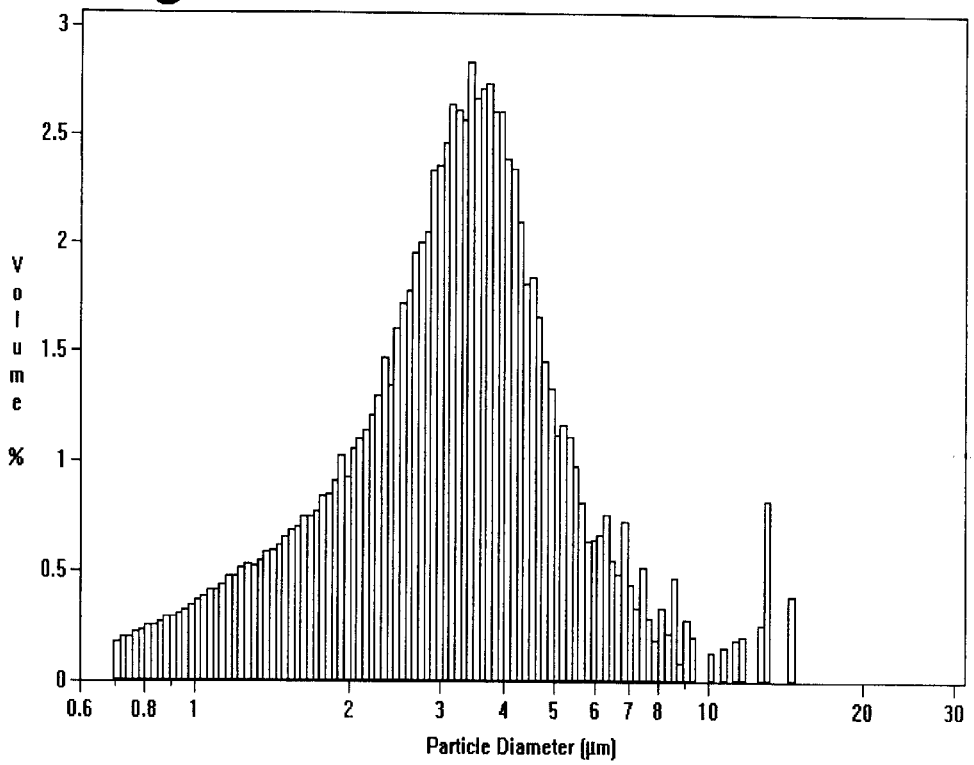

In FIG. 10 the particle size distribution for a demi water-based emulsion of product example 6 is illustrated.

Example 7

This is an example of low energy emulsification. See also example 5. Again a stable emulsion was obtained. The particle size distribution was not as narrow as was shown in earlier examples, however after emulsification no coalescence was observed upon standing for at least 20 hrs.

A product was prepared, consisting of 94 wt % low viscous (10 cS at 40° C.) naphtenic, mineral oil, 1 wt % alkenyl ($C_{12}$) succinic acid anhydride (corrosion inhibitor), 1 wt % $C_{18}$-fatty acid (corrosion inhibitor), 2 wt % sodium petroleum sulphonate (co-surfactant; mol. weight of about 530;), 1 wt % triethanol amine (corrosion inhibitor, neutralising agent) and 1 wt % $C_{16}$-APVP (from example 1). A 3.75 wt % emulsion was prepared in 10° dH water, under low shear (Little Giant® pump in a recirculation system).

The following characteristics were observed:

1. Fast emulsification. Equilibrium particle size is only reached after several hrs (mean particle size slowly decreases from 15+μm to about 2 μm—see FIG. 10. In the next 24 hrs the particle size did not change significantly.
2. The emulsion remains stable upon standing for at least 20 hrs (cream related with droplet size is formed that is readily re-emulsifiable, no oil coalescence was observed)
3. Foam break: excellent (fast and efficient)
4. pH: 7.8
5. No, or hardly any (visible) metal soaps were formed.

Figure 11:
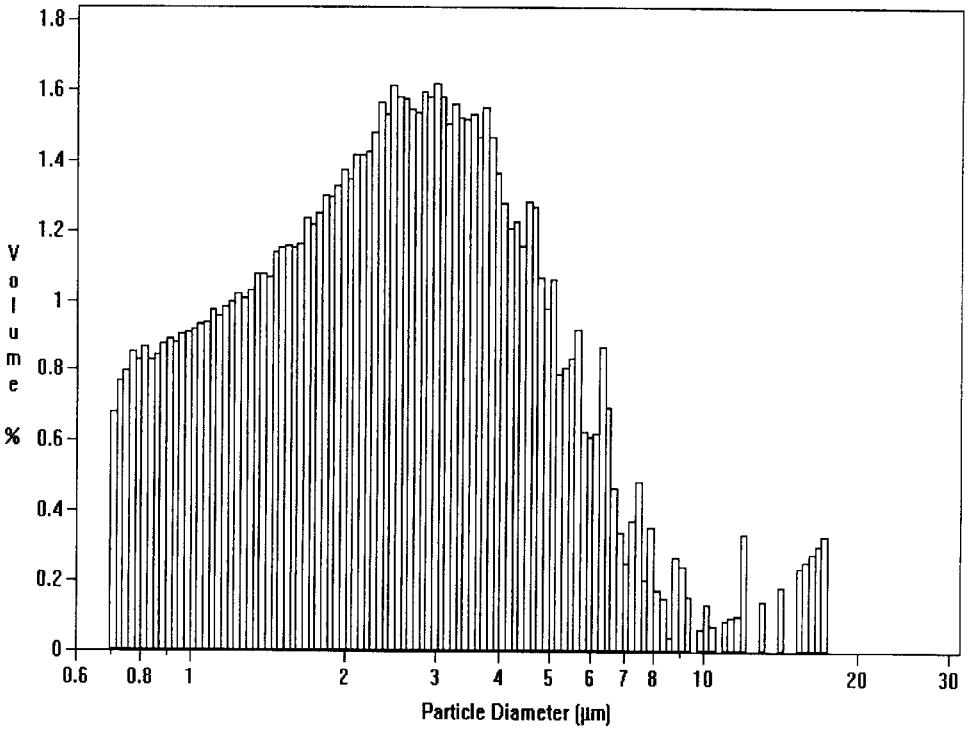

In FIG. 11 the particle size distribution for a 10° dH water-based emulsion of product example 7 is illustrated.

Example 8

With this example it is shown that the manufacturing process of the polymer is not necessarily critical. A $C_{16}$-alkylated polyvinylpyrrolidone (internally indicated with Polymer 804) was obtained by co-polymerisation of vinylpyrrolidone and $C_{16}$-Olefin (mol ratio 2:1) in xylene under reflux.

A product was made, consisting of 80.5 wt % trimethylol propanetriester, 10 wt % paraffinic mineral oil, 8 wt % sulphurised lard oil, 0.25 wt % tetrabutyl methylenediphenol, 0.25 wt % tolutriazole and 1 wt % $C_{16}$-alkylated polyvinylpyrrolidone, internally indicated with Polymer 804. Thereof stable, 3 wt % oil-in-water emulsions were prepared.

After 26 hrs circulation at 50° C., the following emulsion characteristics were measured:

| Characteristic | Unit | Demi-based | 10°dH-based |
|---|---|---|---|
| Emulsion particle size (geometric mean) | μm | 3.2 | 3.1 |
| Remaining oil concentration | wt % | 2.7 | 2.8 |

Figure 12A:
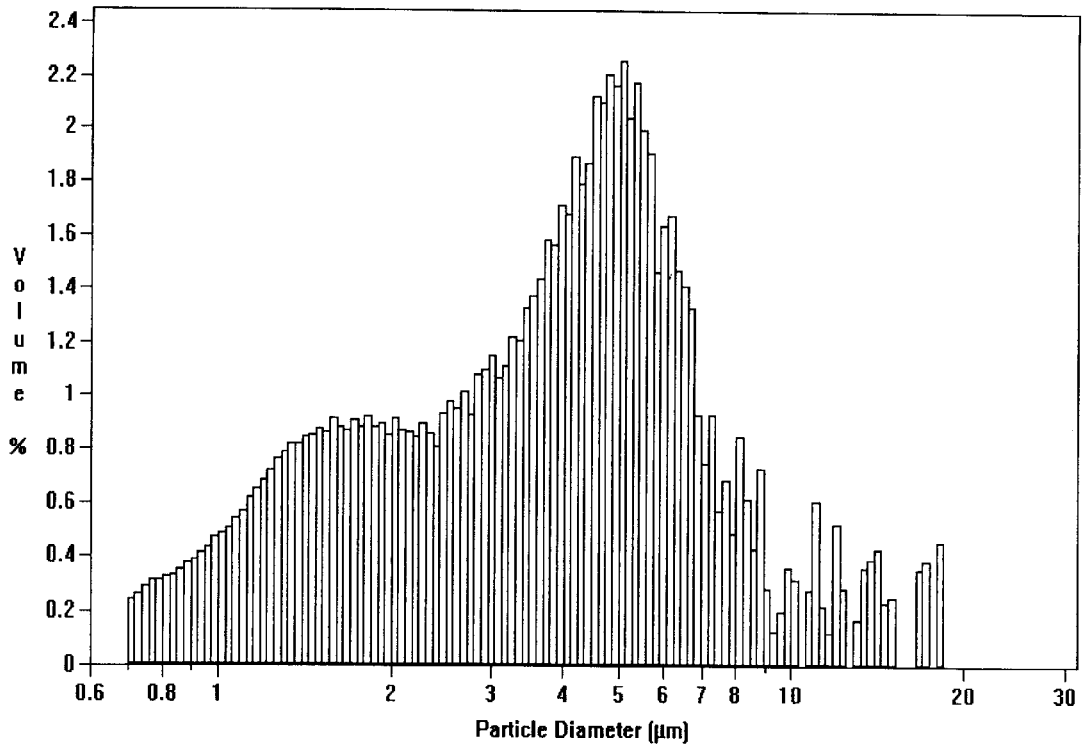
Figure 12B:
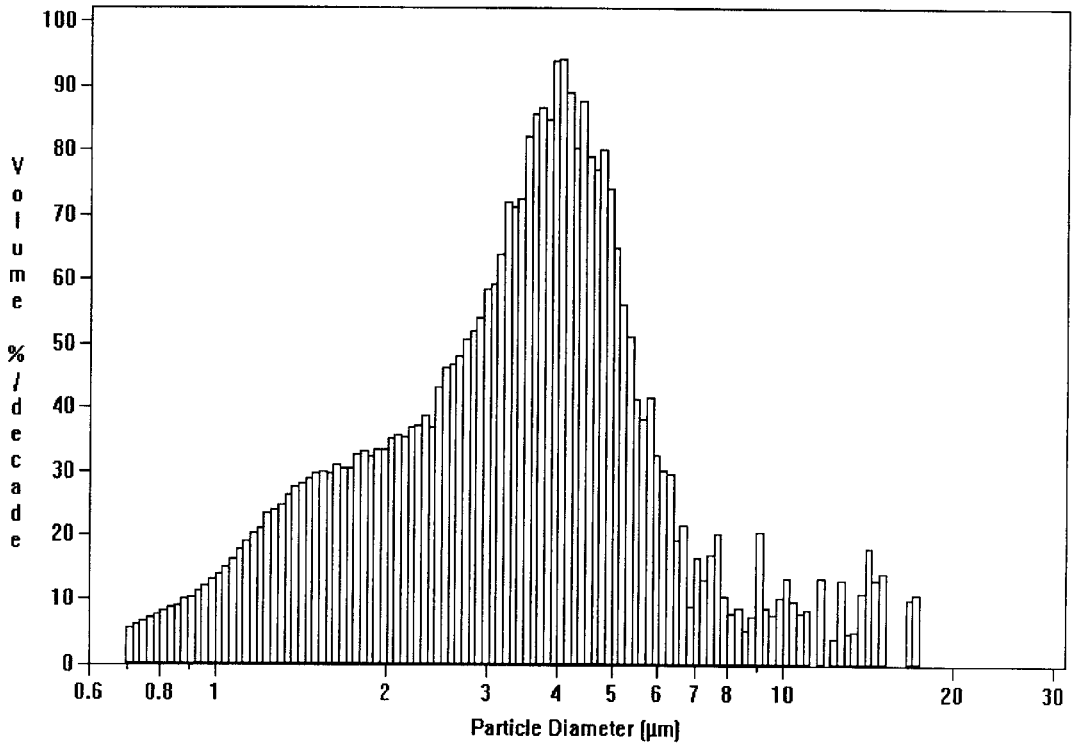

In FIG. 12*a* and FIG. 12*b* the particle size distribution for a demi-water emulsion (top) and for a 10° dH water-based emulsion (down) of product example 8 are illustrated.

Example 9

With this example it is shown that the HLB of the lubricant base (ester and mineral oil) can be reduced without losing performance. Compared with the previous example the mineral oil content of the oil was increased up to 30 wt %.

A product was prepared, consisting of 60.5% trimethylol propanetriester, 30% paraffinic, mineral oil, 8 wt % sulphurised lard oil, 0.25 wt % tetrabutyl methylenediphenol, 0.25 wt % tolutriazole and 1 wt % $C_{16}$-alkylated PVP (internally indicated as Polymer 804)

After 146 hrs circulation at 50° C. the following emulsion characteristics were measured:

| Characteristic | Unit | Demi-based | 10°dH-based |
|---|---|---|---|
| Emulsion particle size (geometric mean) | μm | 3.5 | 3.2 |
| remaining oil concentration | wt % | 2.8 | 2.8 |

Figure 13A:
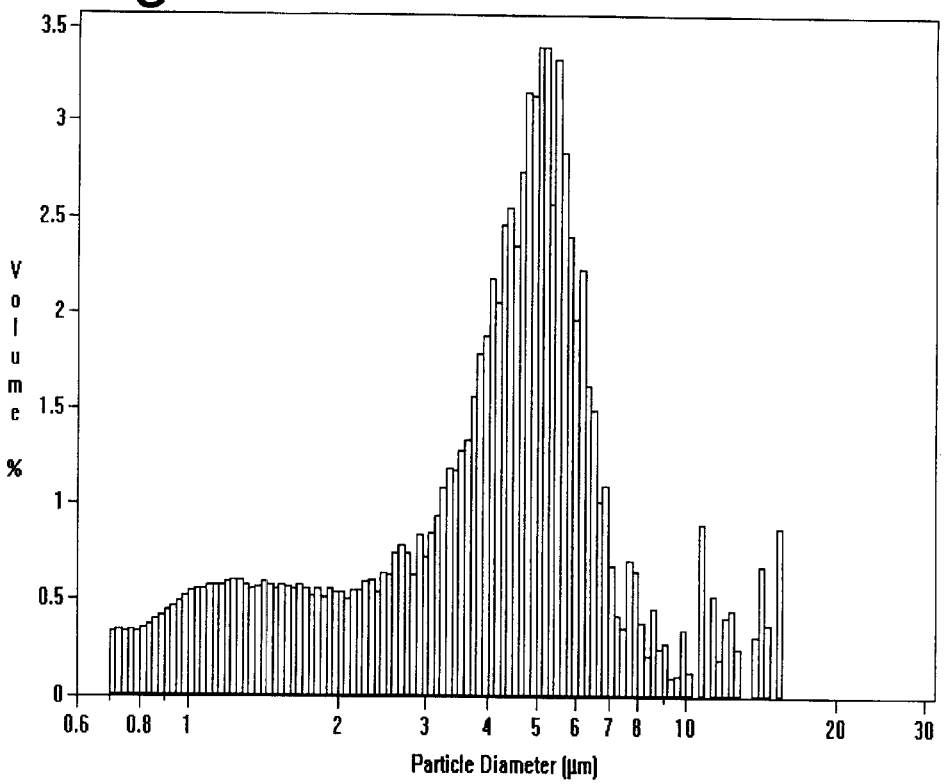
Figure 13B:
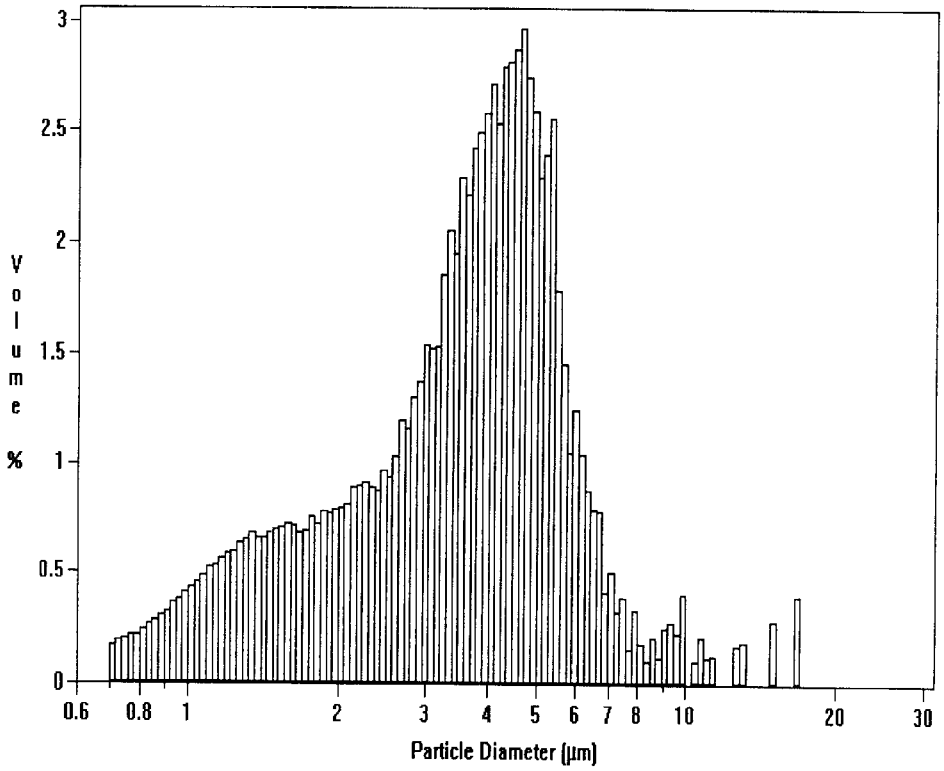

In FIG. 13*a* and FIG. 13*b* the particle size distribution for a demi-water emulsion (top) and for a 10° dH water-based emulsion (down) of product example 9 are illustrated.

Example 10

In this example it is shown that, in addition to co-polymers based on vinylpyrrolidone and olefins, also co-polymers based on vinylpyrrolidone and alkylacrylates can be used as alkylated polyvinylpyrrolidones.

A product was made, consisting of 80.5 wt % trimethylol propanetriester, 10 wt % paraffinic, mineral oil, 8% sulphurised lard oil, 0.25 wt % tetrabutyl methvlenediphenol, 0.25 wt % tolutriazole and 1 wt % alkylated vinylpyrrolidone (VP), being a blend of 2 co-polymers of vinylpyrrolidone and $C_{12}$-acrylate ester (Polymer 790/Polymer 791 blend with weight ratio 1:1). In Polymer 790 the weight ratio of VP/$C_{12}$-acrylate is 75:25; in Polymer 791 this ratio is 65:35. From this lubricant oil a stable 3 wt % oil-in-water emulsion was prepared.

After 26 hrs circulation at 50° C. the following emulsion characteristics were measured:

| Characteristic | Unit | Demi-based | 10°dH-based |
|---|---|---|---|
| Emulsion particle size (geometric mean) | μm | 2.8 | 2.8 |
| Remaining oil concentration | % | 2.7 | 2.7 |

Figure 14A:
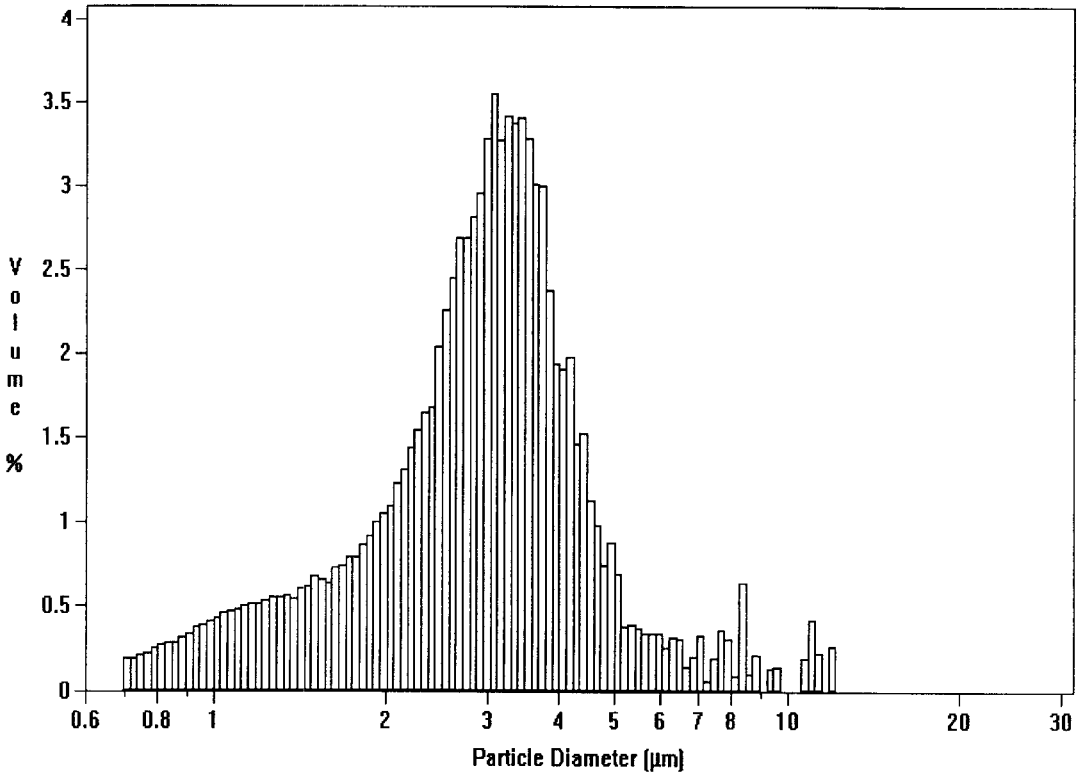
Figure 14B:
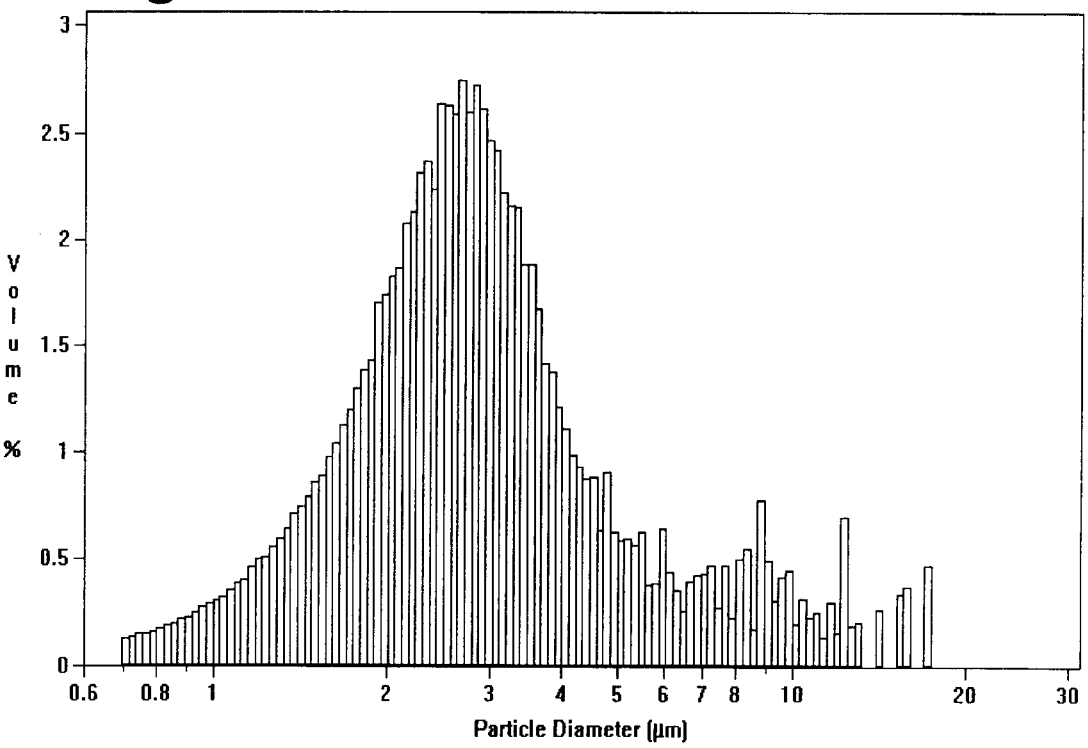

In FIG. 14*a* and FIG. 14*b* the particle size distribution for a demi-water emulsion (top) and for a 10° dH water-based emulsion (down) of product example 10 are illustrated.

CHARACTERISTICS OF ALKYLATED POLYVINYLPYRROLIDONES USED IN THE EXAMPLES

| | |
|---|---|
| Name: | ANTARON V516 (ISP Inc.) |
| Actives (wt %): | 50 |
| Carrier: | Isopropanol (50 wt %) |
| Content vinylpyrrolidone (wt %): | 50 |
| Copolymers: | Vinylpyrrolidone and Hexadecene ($C_{16}$-Olefin) |
| Molecular Weight: | About 9500, see GPC analysis below |
| Method: | See GPC analysis below |
| Preparation: | |
| Solvent: | Isopropanol |
| CAS registry NO: | 00063231-81-2 |
| Name: | POLYMER 804 |
| Carrier: | None |
| Content vinylpyrrolidone (wt %): | 50 |

-continued

CHARACTERISTICS OF ALKYLATED POLYVINYLPYRROLIDONES USED IN THE EXAMPLES

| | |
|---|---|
| Alkyl chain length (nr of C-atoms): | Vinylpyrrolidone and Hexadecene ($C_{16}$-Olefin) |
| Molecular Weight: | About 3600; see GPC analysis below |
| Method: | See GPC analysis below |
| Preparation: | |
| Temperature: | 120–150 C |
| Solvent: | Xylene |
| Name: | POLYMER 790 |
| Actives (wt %): | 24.6 |
| Carrier: | $C_9$-Phtalic Acid Di-ester |
| Content vinylpyrrolidone (wt %): | 75 |
| Alkyl chain length (nr of C-atoms): | Vinylpyrrolidone and $C_{12}$-Alkyl Acrylate |
| Molecular Weight | |
| Method: | GPC with PLA column! |
| Weight average: | 5000 |
| Preparation | |
| Temperature: | 120–150 C |
| Solvent: | Xylene |
| Name: | POLYMER 791 |
| Actives (wt %): | 24.6 |
| Carrier: | $C_9$-Phtalic Acid Di-ester |
| Content vinylpyrrolidone (wt %): | 65 |
| Alkyl chain length (nr of C-atoms): | Vinylpyrrolidone and $C_{12}$-Alkyl Acrylate |
| Molecular Weight: | |
| Method: | GPC with PLA column! |
| Weight average: | 5000 |
| Preparation: | |
| Temperature: | 120–150 C |
| Solvent: | Xylene |

What is claimed is:

1. Metal working process which comprise applying to using a metal surface an effective amount of an oil-in-water emulsion and one or more alkylated polyvinylpyrrolidones as a metal working fluid.

2. The metal working process according to claim 1, wherein the alkylated polyvinylpyrrolidones are based on vinylpyrrolidone and one or more compounds selected from the group consisting of olefins and alkyl(meth)acrylates.

3. The metal working process according to claim 2, wherein the olefins are $C_4$–$C_{30}$ α-olefins.

4. The metal working process according to claim 2, wherein the alkyl(meth)acrylates are $C_4$–$C_{30}$ alkyl(meth) acrylates.

5. The metal working process according to claim 1, wherein the vinylpyrrolidone content in the alkylated polyvinylpyrrolidone is from 5 to 80 mol. %.

6. The metal working process according to claim 1, wherein the alkylated polyvinylpyrrolidone has a mean weight average of 1,000 up to 50,000.

7. The metal working process according to claim 1, wherein the alkylated polyvinylpyrrolidone has a solubility of at least 0.1 wt. % in base lubricants.

8. The metal working process according to claim 1, wherein the alkylated polyvinylpyrrolidone has a water solubility of less than 15 wt. %.

9. The metal working process according to claim 2, wherein the olefins are $C_{10}$–$C_{22}$ α-olefins, the alkyl(meth) acrylates are $C_{10}$–$C_{22}$ alkyl(meth)acrylates, the vinylpyrrolidone content is from 10 to 60 mol. %, the alkylated polyvinylpyrrolidone has a mean weight average of 2,000 up to 25,000, and the alkylated polyvinylpyrrolidone has a water solubility of less than 5 wt. %.

10. The metal working process according to claim 1, wherein the oil content of the oil-in-water emulsion is at most 35 wt. %.

11. Metal working fluid being an oil-in-water emulsion comprising one or more alkylated polyvinylpyrrolidones as well as a lubricant comprising either a corrosion inhibitor or an extreme pressure additive.

12. Metal working fluid according to claim 11, wherein the alkylated polyvinylpyrrolidones are based on vinylpyrrolidone and one or more compounds selected from the group consisting of olefins and alkyl(meth)acrylates.

13. Metal working fluid according to claim 12, wherein the olefins are $C_4$–$C_{30}$ α-olefins.

14. Metal working fluid according to claim 12, wherein the alkyl(meth)acrylates are $C_4$–$C_{30}$ alkyl(meth)acrylates.

15. Metal working fluid according to claim 11, wherein the vinylpyrrolidone content in the alkylated polyvinylpyrrolidone is from 5 to 80 mol. %.

16. Metal working fluid according to claim 11, wherein the alkylated polyvinylpyrrolidone has a mean weight) average of 1,000 up to 50,000.

17. Metal working fluid according to claim 11, wherein the alkylated polyvinylpyrrolidone has a solubility of at least 0.1 wt. % in base lubricants.

18. Metal working fluid according to claim 11, wherein the alkylated polyvinylpyrrolidone has a water solubility of less than 15 wt. %.

19. Metal working fluid according to claim 12, wherein the olefins are $C_{10}$–$C_{22}$ α-olefins, the alkyl(meth)acrylates are $C_{10}$–$C_{22}$ alkyl(meth)acrylates, the vinylpyrrolidone content in the alkylated polyvinylpyrrolidone is from 10 to 60 mol. %, the alkylated polyvinylpyrrolidone has a mean weight average of 2,000 up to 25,000, and the alkylated polyvinylpyrrolidone has a water solubility of less than 5 wt. %.

20. Metal working fluid according to claim 11, wherein the oil content of the oil-in-water emulsion is at most 35 wt. %.

21. A concentrated metal working fluid according to claim 11, wherein the oil content of the concentrated oil-in-water emulsion is at most 60 wt. %.

* * * * *